US007021975B2

(12) United States Patent
Lappöhn

(10) Patent No.: US 7,021,975 B2
(45) Date of Patent: Apr. 4, 2006

(54) PLUG-IN CONNECTOR

(75) Inventor: Jürgen Lappöhn, Gammelshausen (DE)

(73) Assignee: ERNI Elektroapparate GmbH, Adelberg (DE)

( * ) Notice: Subject to any disclaimer, the term of this patent is extended or adjusted under 35 U.S.C. 154(b) by 0 days.

(21) Appl. No.: 10/842,854

(22) Filed: May 11, 2004

(65) Prior Publication Data

US 2004/0229519 A1 Nov. 18, 2004

(30) Foreign Application Priority Data

May 13, 2003 (DE) ..... 103 21 348

(51) Int. Cl.
*H01R 13/40* (2006.01)

(52) U.S. Cl. ..... 439/733.1; 439/751; 439/943

(58) Field of Classification Search ..... 439/733.1, 439/751, 943

See application file for complete search history.

(56) References Cited

U.S. PATENT DOCUMENTS

| | | | | |
|---|---|---|---|---|
| 4,188,715 | A * | 2/1980 | Ammon et al. | 29/884 |
| 4,427,257 | A * | 1/1984 | DeMarco | 439/892 |
| 5,316,503 | A * | 5/1994 | Thompson et al. | 439/740 |
| 6,312,296 | B1 * | 11/2001 | Jones | 439/733.1 |
| 6,394,856 | B1 * | 5/2002 | Wertz | 439/681 |

* cited by examiner

*Primary Examiner*—Tho D. Ta
(74) *Attorney, Agent, or Firm*—Collard & Roe, P.C.

(57) ABSTRACT

A plug-in connector having a housing, particularly a multi-pole, multi-row male or female multi-point plug, whereby the housing is provided with insertion chambers for inserting electrical contact elements. In order to be able to insert different contact elements into one and the same insertion chamber in the housing, this insertion chamber is configured to accommodate different insertion regions.

4 Claims, 3 Drawing Sheets

PLUG-IN CONNECTOR

BACKGROUND OF THE INVENTION

1. Field of the Invention

The present invention finds use in plug-in connectors whose housing has at least one insertion chamber for accommodating contact elements.

2. The Prior Art

Plug-in connectors having a housing are known. In this connection, several electrical contact elements are usually arranged in the housing, in several rows that are parallel to one another, for example, 96 electrical contact elements in three rows. These plug-in connectors correspond to specific DIN standards.

The housing consists of an injection-molded part made of plastic, into which the electrical contact elements can be inserted. These electrical contact elements can be configured in such a manner that they are completely inserted into the housing at one end, from one side, and are configured there in the form of a spring, into which another electrical contact element can be brought into engagement, which is inserted into the housing from the other side. At the other end, the electrical contact elements project beyond the housing.

It is known that the segments of the contact elements that project beyond the housing are configured to have different lengths for specific requirements, in the same plug-in connector. For example, short contact elements having a contact region that projects only slightly beyond the housing, or long contact elements whose contact region is preceded by a guide segment can be provided.

For reasons of stability, the "long" contact elements are made from a heavier sheet-metal cut-out, i.e. with a greater thickness, than the "shorter" contact elements, in known manner. In this connection, the electrical contact elements have an insertion region that is pushed into a corresponding insertion chamber in the housing and held there with a positive lock. Because of the different material thicknesses of the short and long contact elements, these insertion regions of the contact elements also differ, so that different insertion chambers have to be formed in the housing for different contact elements.

In this connection, it is known that all the insertion chambers of a housing of one plug-in connector have the same cross-section, i.e. the same shape, and that a different cross-section shape is formed only in the other insertion chambers into which contact elements having a different cross-sectional shape in the insertion region are later supposed to be inserted, in an additional machining step, for example material removal using a router.

This is connected with significant costs as a result of the additional machining step, and can also result in inaccuracies in the fit.

SUMMARY OF THE INVENTION

It is therefore an object of the invention to improve a plug-in connector so that different contact elements can be inserted into the plug-in connector without any additional machining steps.

According to the invention, this task is accomplished by a plug-in connector having a housing, particularly a multi-pole, multi-row male or female multi-point plug, whereby the housing is provided with insertion chambers for inserting electrical contact elements. In order to be able to insert different contact elements into one and the same insertion chamber in the housing, this insertion chamber is configured to accommodate different insertion regions.

The core idea of the invention consists in the fact that the several insertion chambers in the housing of a plug-in connector are already formed during its production, in other words particularly in an injection-molding process for a plastic housing, in such a manner that contact elements having different cross-sectional shapes can be inserted into the insertion chamber, in the insertion region, in each instance. In this connection, the shape, particularly the cross-section seen in a top view onto the housing, of the insertion chamber can be selected in any desired manner, according to the invention, but will preferably be configured as described below. For example, the insertion chamber can have an essentially rectangular or square cross-section, whereby different edges, shoulders, or projections are formed in the wall of the insertion chamber, which allow the insertion of different insertion regions of different contact elements in the desired orientation, in each instance.

Preferably, the insertion region of the one contact element is thinner than the insertion region of the other contact element. The advantage of the invention consists in the fact that all of the insertion chambers in the housing of the plug-in connector have the same shape, so that production is facilitated and different contact elements having different insertion regions can be inserted into the same insertion chamber without additional machining.

Preferably, at least two different contact elements can be optionally inserted into one insertion chamber, in each instance, of a plug-in connector, whereby the contact elements have an insertion region, in each instance, that is configured to be differently broad and/or thick. If the insertion chamber is appropriately configured, however, even three or more different contact elements can be optionally inserted into the plug-in connector, depending on the specific requirements of the connector.

The insertion region of an electrical contact element has a rectangular cross-section in the axial direction, seen in the longitudinal expanse of the element. This results from the fact that the electrical contact elements are obtained in known manner, in a punching process, from a sheet-metal cut-out, so that this insertion region has the thickness of the original sheet-metal cut-out.

For the contact elements, a rectangular or square insertion chamber having grooves that correspond to one another on its sides that lie opposite one another is provided, so that during the insertion of each contact element, this rectangular insertion region is brought into engagement with the grooves and held there by means of a positive lock. Several different grooves that correspond to one another can be arranged on two opposite sides of the insertion chamber, or a specific groove can even be provided in pairs on two opposite sides. Thereby two contact elements having different insertion regions could be inserted into the different insertion chambers at a 90° angle relative to one another, for example.

In an advantageous further development of the invention, an additional, accordingly narrower groove is made in the bottom of a groove for accommodating an insertion region having a rectangular cross-section. This additional groove serves to accommodate a narrower, i.e. thinner insertion region of another contact element, with reference to the groove originally made. Preferably, such additional grooves are formed on two grooves that lie opposite one another, on two sides of a rectangular insertion chamber. With these additional grooves, it is possible that either a contact element having an insertion region having a large width can be inserted, or a contact element having an insertion chamber having a narrower cross-section can be inserted into the additional, narrower grooves, into one and the same insertion chamber. If a contact element having a broad cross-section is inserted into the insertion chamber, then this insertion region covers the additional, narrower groove made in the first groove. The grooves can be formed over the entire insertion depth of the insertion chamber, or only in segments, seen in the insertion direction.

Because of the production accuracies that can be achieved, it is possible to select the differences in the widths or thicknesses of the insertion regions of different contact elements, preferably in the range of 1/10 mm, so that even special contact elements, which are obtained from sheet-metal cut-outs having only a slightly different material thickness, can be inserted into the insertion chamber, according to the invention, of a housing of a plug-in connector.

A first type of contact element is produced from a sheet-metal cut-out having a thickness of 0.3 mm, and a second type of contact element is produced from a sheet-metal cut-out having a thickness of 0.6 mm. Accordingly, the preferably rectangular insertion regions of the contact elements, in each instance, have a thickness of 0.3 mm and 0.6 mm, respectively, seen in the axial longitudinal direction of the contact element.

The production of the grooves and the additional narrower grooves arranged in them, in the wall of an insertion chamber of a housing of a plug-in connector, can be carried out in the production of the connector from plastic, using the injection-molding method.

Therefore it is possible to insert both a first type of contact element having a short contact region, made from a thinner sheet-metal cut-out, and a second type of contact element having a longer transfer zone, made from a heavier (thicker) sheet-metal cut-out than in the case of the former, which is necessary for stability reasons, into a single housing of a plug-in connector, each into one of the insertion chambers.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
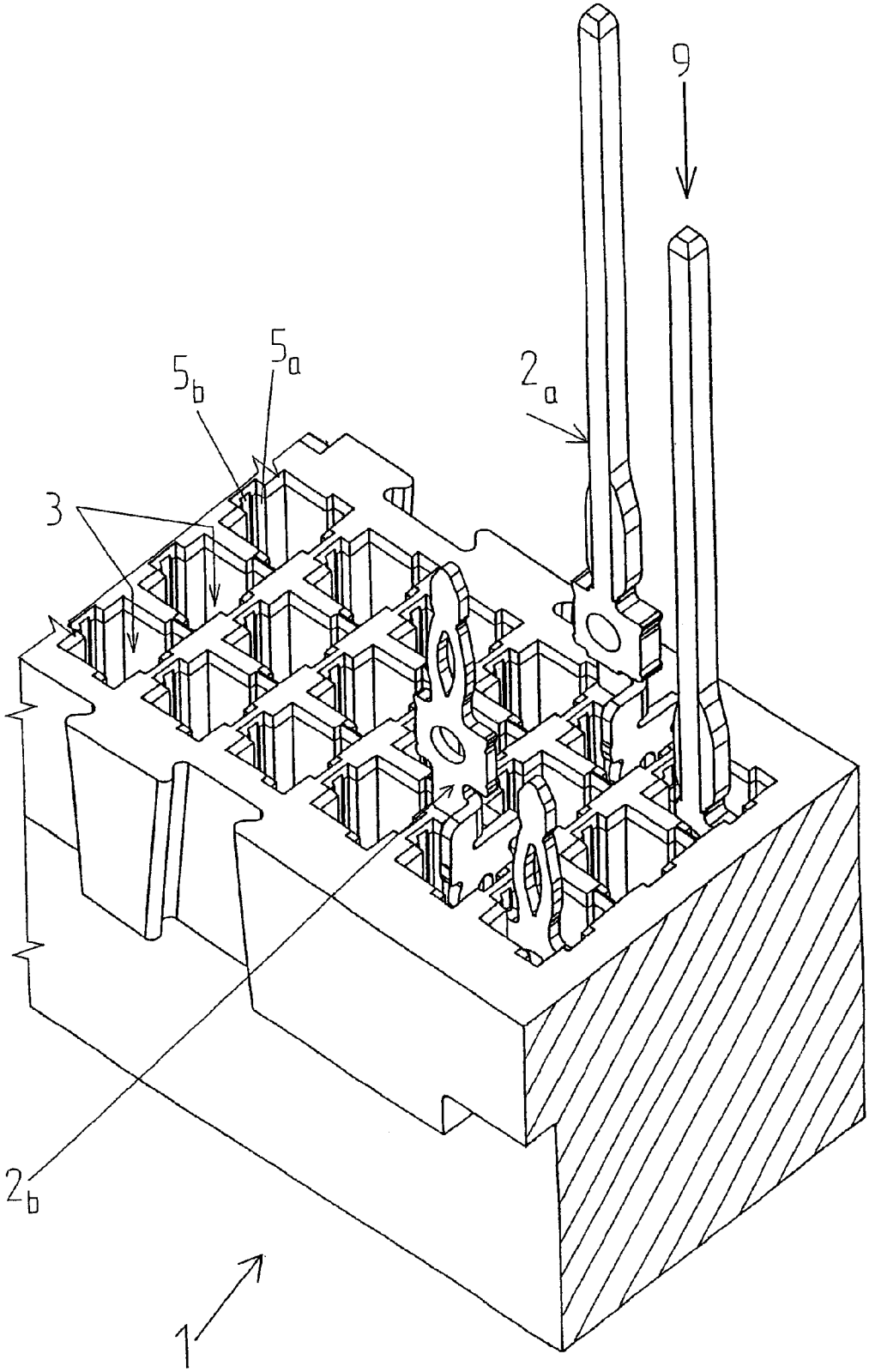
FIG. 1 shows a housing of a preferred embodiment of a plug-in connector according to the invention, in a perspective top view.

The exemplary embodiment of the invention shown in FIG. 1 is a housing 1 of a plug-in connector, particularly a male or female multi-point plug. These plug-in connectors meet certain DIN standards, whereby different contact elements 2*a* and 2*b* are inserted into housing 1, at the plug-in spot in housing 1. For example, contact elements 2*a* that have a shorter contact region 6 and a long, pin-shaped guide segment 7 that directly follows the latter, or other contact elements 2*b*, which possess a short contact region 6*b* of a different shape, can be used.

For stability reasons, contact elements 2*a* are made from a heavier, i.e. thicker material than the other contact elements 2*b* having the short contact region 6, in order to avoid bending of the long guide segment 7 when it is plugged onto another connection element or a circuit board or card.

Figures 3, 4:
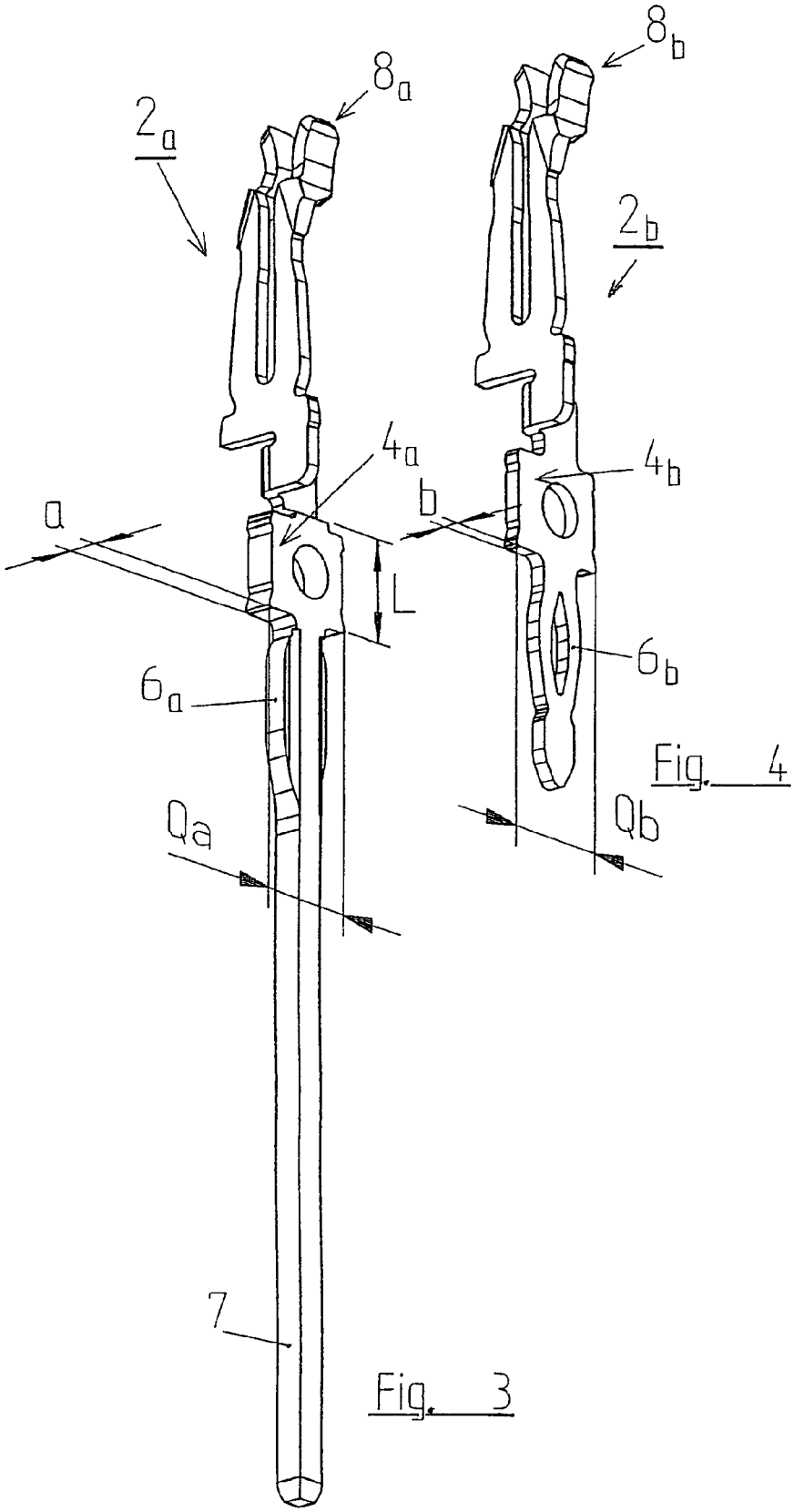
FIG. 3 shows a first, long contact element.
FIG. 4 shows a second, shorter contact element.

In order to align and hold contact elements 2*a* and 2*b* in housing 1, in each instance, in the desired position, an insertion region 4*a* or 4*b*, respectively, is formed on contact elements 2*a* and 2*b*, which is held in one of insertion chambers 3 in housing 1, in each instance, and prevents contact element 2*a*, 2*b* from falling out or slipping out of place. The details of contact elements 2*a* and 2*b* are shown in FIGS. 3 and 4, respectively.

Insertion regions 4*a* of first contact element 2*a* have a material thickness "a" (thickness) and insertion regions 4*b* of another contact element 2*b* have the material thickness "b" (thickness).

Figure 2:
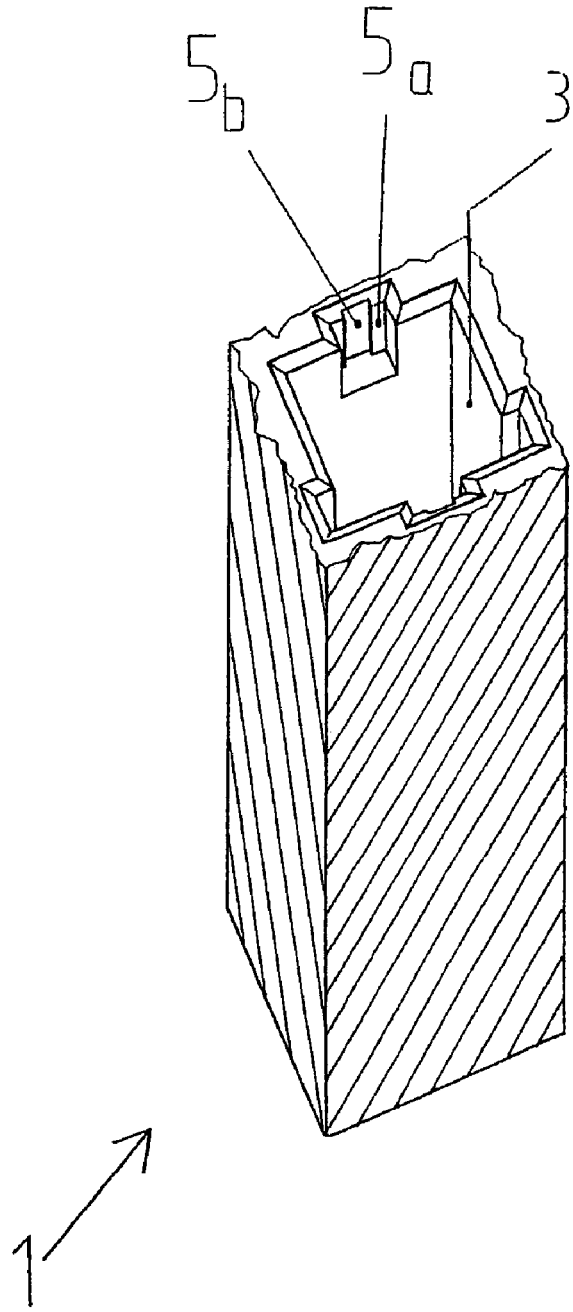
FIG. 2 shows a perspective top view of a partial region of the housing according to FIG. 1.

In order to be able to insert a contact element 2*a* or, alternatively, a contact element 2*b* into a single insertion chamber 3, first grooves 5*a* having a width "a" corresponding to material thickness "a" of the first contact element 2*a* are made in the wall of the insertion chamber 3, see FIGS. 1 and 2. These grooves are formed in two sides of insertion chamber 3 that lie opposite one another. Additional grooves 5*b*, corresponding to the material thickness "b" of additional contact element 2*b*, are made in the bottom of these first grooves 5*a*, whereby the difference between "a" and "b" is kept variable, depending on the case of use; for example, "a" can be 0.6 mm and "b" can be 0.3 mm, "a" can be 0.4 mm and "b" can be 0.3 mm, or "a" can be 0.35 mm and "b" can be 0.15 mm, with the usual dimensional tolerances; any other variant in the range from 0.1 mm to 0.8 mm is also possible. Here, grooves 5*a*, 5*b* are formed in the wall of the insertion chamber 3, seen in the insertion direction 9, in accordance with the length "L" of the insertion region 4*a* of the contact element 2*a*.

In order to hold the different insertion regions 4*a*, 4*b* of contact elements 2*a*, 2*b*, in each instance, in grooves 5*a*, 5*b*, the crosswise expanse "Qa," "Qb" of insertion regions 4*a*, 4*b* must also be selected accordingly. This means that the thicker insertion region 4*a*, having the greater material thickness "a," is slightly smaller in its crosswise expanse "Qa" than the crosswise expanse "Qb" (width) of the insertion region 4*b*. The appropriate sizing of insertion regions 4*a* and 4*b* in their crosswise expanse (width) "Qa" and "Qb," respectively, is possible for a person skilled in the art, when punching contact elements 2*a* and 2*b*, respectively, along with their insertion region 4*a* and 4*b*, respectively.

In the inserted state of the first, long contact element 2*a*, its insertion region 4*a* lies directly against the bottom of first groove 5*a*, and thereby covers the additional groove 5*b* worked into the bottom of groove 5*a*. If, on the other hand, insertion region 4*b* of the additional contact element 2*b* is inserted into insertion chamber 3 of the housing 1 of the plug-in connector, this insertion region 4*b* passes through first groove 5*a* and is held in the additional, narrower groove 5*b* with a positive lock.

Accordingly, while only a few embodiments of the present invention have been shown and described, it is obvious that many changes and modifications may be made thereunto without departing from the spirit and scope of the invention.

Reference Symbol List

| | |
|---|---|
| 1 | housing |
| 2a | contact elements (long embodiment) |
| 2b | contact elements (short embodiment) |
| 3 | insertion chamber |
| 4a | insertion region of item 2a |
| 4b | insertion region of item 2b |
| 5a | grooves in item 3 for item 2a |
| 5b | grooves in item 3 for item 2b |
| 6a | contact region of item 2a |
| 6b | contact region of item 2b |
| 7 | guide segment (pin-shaped) of item 2a |
| 8a | spring segment of item 2a |
| 8b | spring segment of item 2b |
| 9 | insertion direction |
| a | material thickness of item 2a (thickness) |
| b | material thickness of item 2b (thickness) |
| Qa | crosswise expanse of item 2a (width) |
| Qb | crosswise expanse of item 2b (width) |
| L | length of item 4a |

What is claimed is:

1. A plug-in connector comprising:

a housing;

electrical contact elements that can be pushed into the housing, an insertion chanter formed in the housing for each contact element, a cross-section of each chamber having grooves to accommodate an insertion region of a corresponding contact element, wherein different contact elements having different insertion regions, which, when viewed in an axial direction, have rectangular cross-sections, are insertable into the plug-in connector, and wherein at least one of the insertion chambers is configured to accommodate different insertion regions in such a manner that an additional groove for accommodating an insertion region of another contact element is formed in a bottom of one of said grooves.

2. Plug-in connector according to claim 1, wherein a difference between crosswise expanses of the insertion regions is between 0.05 and 0.02 mm, and preferably amounts to 0.1 mm.

3. Plug-in connector according to claim 1, wherein the insertion region of a first type of contact element preferably possesses a thickness (a) of 0.3 mm, wherein the insertion region of a second type of contact element preferably possesses a thickness (b) of 0.6 mm, and wherein said first and second types of contact elements are inserted into the housing.

4. Plug-in connector according to claim 3, wherein the first type of contact element is provided with a short contact region, and the second type of contact element is provided with a long transfer zone.

* * * * *